US008586274B2

(12) United States Patent
Yuge et al.

(10) Patent No.: US 8,586,274 B2
(45) Date of Patent: Nov. 19, 2013

(54) TONER FOR DEVELOPING ELECTROSTATIC CHARGE IMAGE AND PROCESS FOR ITS PRODUCTION

(75) Inventors: Tetsuharu Yuge, Yokohama (JP); Yuqing Xu, Yokohama (JP)

(73) Assignee: Mitsubishi Chemical Corporation, Tokyo (JP)

( * ) Notice: Subject to any disclaimer, the term of this patent is extended or adjusted under 35 U.S.C. 154(b) by 230 days.

(21) Appl. No.: 13/117,610

(22) Filed: May 27, 2011

(65) Prior Publication Data

US 2011/0294063 A1 Dec. 1, 2011

(30) Foreign Application Priority Data

May 27, 2010 (JP) ..... 2010-121983

(51) Int. Cl.
*G03G 9/087* (2006.01)

(52) U.S. Cl.
USPC ..... 430/109.3; 430/111.4; 430/137.15

(58) Field of Classification Search
USPC ..... 430/111.4, 109.3, 137.15, 137.17
See application file for complete search history.

(56) References Cited

U.S. PATENT DOCUMENTS

| | | | | |
|---|---|---|---|---|
| 3,853,778 | A | 12/1974 | Buckley et al. | |
| 5,753,399 | A | 5/1998 | Hayase et al. | |
| 5,948,584 | A | 9/1999 | Hashimoto et al. | |
| 7,642,031 | B2 * | 1/2010 | Daimon et al. | 430/109.3 |
| 2002/0106573 | A1 | 8/2002 | Hamano et al. | |
| 2003/0040585 | A1 | 2/2003 | Shirai et al. | |
| 2004/0053153 | A1 | 3/2004 | Yaguchi et al. | |
| 2005/0159530 | A1 | 7/2005 | Lee et al. | |
| 2007/0207401 | A1 | 9/2007 | Shirai | |
| 2009/0142110 | A1 | 6/2009 | Oya et al. | |

FOREIGN PATENT DOCUMENTS

| | | | |
|---|---|---|---|
| JP | 48-79639 | | 10/1973 |
| JP | 6-194874 | | 7/1994 |
| JP | 7-301949 | | 11/1995 |
| JP | 8-95294 | | 4/1996 |
| JP | 11-44967 | | 2/1999 |
| JP | 2002-182428 | | 6/2002 |
| JP | 2002-284866 | | 10/2002 |
| JP | 2003-246920 | A1 * | 9/2003 |
| JP | 2005-208653 | | 8/2005 |
| JP | 2005-234046 | | 9/2005 |
| JP | 2005-308995 | | 11/2005 |
| JP | 2006-113473 | | 4/2006 |

OTHER PUBLICATIONS

USPTO English-language translation of JP 2003-246920 (pub. Sep. 2003).*

American Chemical Society (ACS) File Registry No. RN 18299-85-9, copyright 2013 ACS on STN, which entered STN on Nov. 16, 1984.*

* cited by examiner

*Primary Examiner* — Janis L Dote

(74) *Attorney, Agent, or Firm* — Oblon, Spivak, McClelland, Maier & Neustadt, L.L.P.

(57) ABSTRACT

A toner for developing an electrostatic charge image, which satisfies both low temperature fixing property and blocking resistance and which is excellent in the fixed image strength and further excellent in the production stability and is capable of presenting a constant quality, and a process for its production, which toner comprises a binder resin containing a crystalline resin, and wax, and which has, in its DSC curve measured by a differential scanning calorimeter, an endothermic peak of from 0.01 to 10 mJ/mg at a temperature of at most 45° C. during its temperature rise.

11 Claims, 1 Drawing Sheet

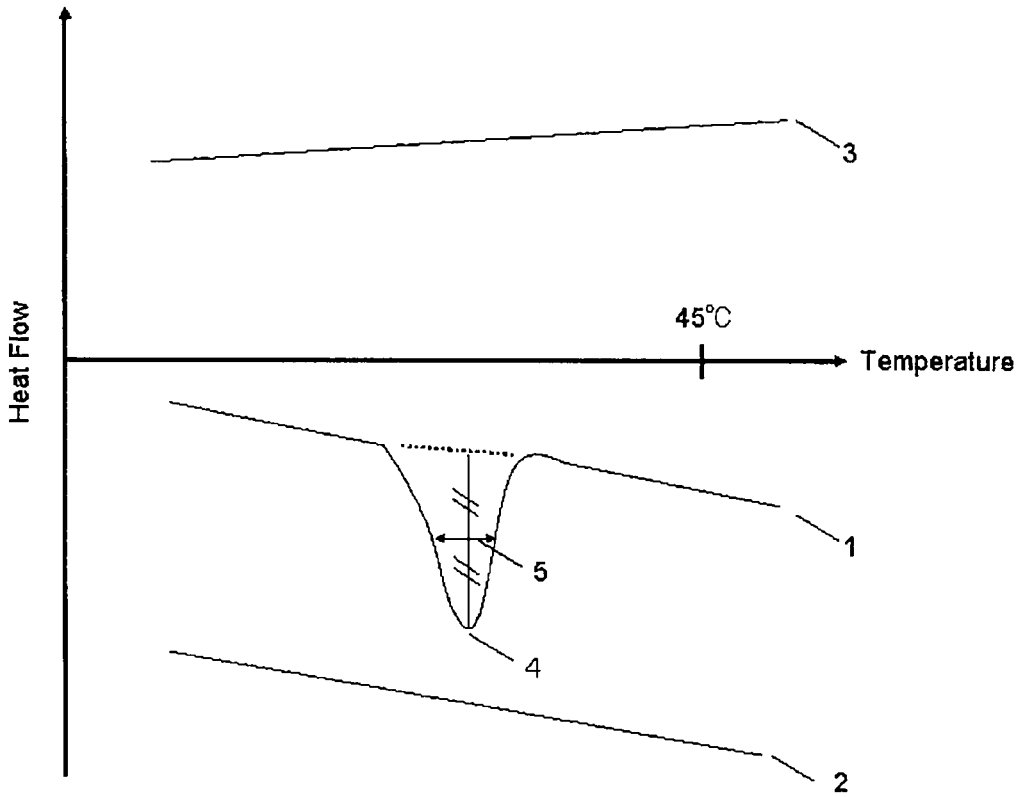
Heat Flow
45°C
Temperature
3
1
5
4
2

TONER FOR DEVELOPING ELECTROSTATIC CHARGE IMAGE AND PROCESS FOR ITS PRODUCTION

BACKGROUND OF INVENTION

1. Technical Field

The present invention relates to a toner for developing an electrostatic charge image and a process for its production. More specifically, it relates to a toner for developing an electrostatic charge image, which satisfies both low temperature fixing property and blocking resistance and which is excellent in the fixed image strength and further in the production stability and is capable of presenting a constant quality, and a process for its production.

2. Discussion of Background

The toner for developing an electrostatic charge image is used for formation of an image to visualize an electrostatic image in e.g. a printer, a copying machine or a facsimile machine. With reference to formation of an image by an electrophotographic system, an electrostatic latent image is firstly formed on a photoconductor drum, then it is developed with a toner and then transferred to e.g. transfer paper, followed by fixing by e.g. heat to form an image. The toner for developing the electrostatic charge image at that time is usually one in such a form that solid fine particles of e.g. silica are attached, as an additive, to the surface of toner particles obtained by a so-called melt-kneading pulverization method wherein to a binder resin and a colorant, as the case requires, an electrification-controlling agent, a release agent, a magnetic material, etc. are dry-mixed, followed by melt kneading by e.g. an extruder and then by pulverization and classification, for the purpose of imparting various properties such as flowability.

In recent years, in formation of an image by a copying machine or printer, a highly fine image quality is required, and in order to satisfy such a requirement, it is necessary that the average particle diameter of toner particles is at a level of from 3 to 8 μm, and the particle size distribution is narrow. However, in the melt kneading pulverization method, it is difficult to control the particle diameter of the toner particles, and if it is attempted to obtain toner particles having an average particle diameter within a range of from 3 to 8 μm, there has been a problem such that a fine powder having a diameter smaller than the desired particle diameter is formed in a large amount as a byproduct, and it has been difficult to separate it in a classification step.

As a method for overcoming such a problem in the melt kneading pulverization method, it has been proposed to use a production method by a polymerization method such as a suspension polymerization, an emulsion polymerization coagulation method or a solution suspension method, instead of the melt kneading pulverization method.

The suspension polymerization method is a method wherein a composition comprising a polymerizable monomer, a polymerization initiator, a colorant, etc. as components, is suspended and dispersed in an aqueous medium, followed by polymerization to obtain toner particles. The emulsion polymerization coagulation method is a method wherein a polymerizable monomer is emulsified in an aqueous medium containing a polymerization initiator and an emulsifier, the polymerizable monomer is polymerized with stirring to obtain polymer primer particles, to which a colorant and, as the case requires, an electrification-controlling agent, etc. are added to coagulate polymer primary particles, and further, the obtained coagulated particles are aged to produce toner particles. Further, the solution suspension method is a method wherein a binder resin is dissolved in an organic solvent, a colorant, etc. are added and dispersed to obtain a solution phase, which is dispersed in an aqueous phase containing a dispersant, etc. by a mechanical shearing force to form liquid droplets, and from such liquid droplets, the organic solvent is removed to produce toner particles.

By these polymerization methods, it is easy to control the particle diameters of the toner particles, and it is possible to obtain toner particles which have a small particle diameter and a narrow particle size distribution and which are capable of forming a highly fine image quality.

The suspension polymerization method and the emulsion polymerization coagulation method has a merit such that the energy required for the production of the toner is small as compared with the solution suspension method wherein granulation is carried out by means of a separately prepared binder resin, since the polymerization of the polymerizable monomer and the granulation of toner particles are carried out in the production process, and further it is thereby easy to prepare a toner having a small diameter and easy to control the particle size distribution or particle diameter.

Further, in recent years, along with dissemination of copying machines, printers, etc., in addition to the demand for the image quality, a toner excellent particularly in the high speed printing and low energy fixing property has been desired, and it has been attempted to improve the low temperature fixing property of the toner. The low temperature fixing property and the blocking resistance or high temperature offset resistance are usually in a trade-off relation, and it is difficult but desired to satisfy both properties.

To accomplish such an object, wax is used as an offset-preventing agent. However, the wax content in a toner is limited, and if wax is used excessively, leakage from the toner occurs to deteriorate the blocking resistance. Therefore, improvement of the low temperature fixing property by wax is limited.

As a method for improving the low temperature fixing property, a technique of incorporating a crystalline polyester resin to a non-crystalline resin thereby to improve the low temperature fixing property has been proposed (Patent Documents 1 to 5).

In a case where such a crystalline polyester resin is incorporated as dispersed in a non-crystalline resin having poor compatibility, for example, in a case where the non-crystalline resin is a styrene type resin, dispersed domains of the crystalline polyester component are not dispersed in a sufficiently small size, whereby the obtained toner is brittle as a drawback of the crystalline resin or exhibits adhesion to components during the development, or has had a problem such that the temperature range for fixing becomes very small, since the elasticity at the time of heating sharply decreases.

On the other hand, in a case where such a crystalline polyester resin is incorporated as dispersed in a non-crystalline resin having good compatibility, for example, in a case where the non-crystalline resin is a polyester resin, when it is dispersed by melt-kneading, no adequate dispersibility is obtainable, and it has been possible only to obtain a toner having the same drawback as in the case where dispersed in the non-crystalline resin having poor compatibility.

Further, if a crystalline polyester and a non-crystalline polyester are used in combination, such may be effective for improvement of the low temperature fixing property, but they become partly compatible, whereby the glass transition temperature lowers, and accordingly, the blocking resistance tends to be inadequate. With respect to this problem, it has been reported that an improvement is observed by carrying out a heat treatment step, but a very long time is required for the treatment.

In the case of mixing dispersions having such crystalline and non-crystalline polyester resins finely dispersed, respectively, too much energy or assisting power of an organic solvent is required to disperse the non-crystalline polyester resin in water, whereby the cost will be high, and if an alkali is used as a dispersing aid, there has been a problem such that the performance deteriorates due to hydrolysis. Further, a tin-type catalyst which has been commonly used to design the molecular weight so that this non-crystalline polyester resin will acquire a good fixing property, has a drawback of contaminating the environment, and a safe resin to assist a good fixing property has not yet been obtained.

Whereas, a method of using a low melting point crystalline resin containing a long chain (meth)acrylic acid ester has been proposed (Patent Document 6). Such a monomer can easily be emulsified and is very suitable for the production of a toner in an aqueous system. However, if such a long chain (meth)acrylic acid ester polymer is used as a binder resin, brittleness results, and the fixed image strength tends to be remarkably deteriorated, whereby image defects are likely to form by bending or scratching (Patent Document 6). Further, if a long chain (meth)acrylic acid ester and a vinyl monomer are simply copolymerized (Patent Documents 7 and 8), the melting point decreases, and the blocking resistance tends to be deteriorated. For the same reason, the blocking resistance tends to be deteriorated if a long chain (meth)acrylic acid ester polymer having a low melting point is used.

Further, a method for producing a latex has been proposed wherein a long chain (meth)acrylic acid ester polymer is modified by a non-crystalline resin to form a core/shell structure, and the long chain (meth)acrylic acid ester polymer is used as a release agent (Patent Document 9). However, such a latex has had a problem such that the storage elastic modulus is high in such a state that the long chain (meth)acrylic acid ester polymer is melted, and even if formed into a toner, the release effect is not sufficient only with the long chain (meth)acrylic acid ester polymer, and offset is likely to result, the gloss tends to be low, and further, since the particle diameter of the latex is large, coarse particles are likely to form when agglomerated together with a pigment.

Patent Document 1: US 2002/0106573 A1
Patent Document 2: US 2003/0040585 A1
Patent Document 3: JP-A-2005-234046
Patent Document 4: JP-A-2006-113473
Patent Document 5: US 2007/0207401 A1
Patent Document 6: U.S. Pat. No. 3,853,778
Patent Document 7: JP-A-7-301949
Patent Document 8: JP-A-8-95294
Patent Document 9: US 2005/0159530 A1

SUMMARY OF INVENTION

The present invention relates to a process for producing a toner for developing an electrostatic charge image and is to provide a toner for developing an electrostatic charge image, which satisfies both low temperature fixing property and blocking resistance and which is excellent in the fixed image strength and gloss and further excellent in the production stability and is capable of presenting a constant quality, and a process for producing such a toner.

The present inventors have conducted an extensive study to solve the above problems and have found it possible to solve the problems by devising a structure for the binder resin contained in a toner. The present invention is based on such a discovery and provides the following.

1. A toner for developing an electrostatic charge image, which comprises a binder resin and wax, and which has, in its DSC curve measured by a differential scanning calorimeter, an endothermic peak of from 0.01 to 10 mJ/mg at a temperature of at most 45° C. during its temperature rise.

2. The toner for developing an electrostatic charge image according to the above 1, which has no exothermic peak at a temperature of at most the temperature for the endothermic peak present at a temperature of at most 45° C., during cooling after the toner is heated to 120° C.

3. The toner for developing an electrostatic charge image according to the above 1 or 2, which has no endothermic peak at a temperature of at most 45° C., when the toner is heated to 120° C., then cooled to −20° C. and then heated again.

4. The toner for developing an electrostatic charge image according to any one of the above 1 to 3, wherein the endothermic peak present at a temperature of at most 45° C., is present at a temperature of at least 20° C.

5. The toner for developing an electrostatic charge image according to the above 3 or 4, wherein the endothermic peak is not present at a temperature of from 20 to 45° C.

6. The toner for developing an electrostatic charge image according to any one of the above 1 to 5, wherein the half-value width of the endothermic peak of the toner at a temperature of at most 45° C. during its temperature rise is at most 10° C.

7. The toner for developing an electrostatic charge image according to any one of the above 1 to 6, which has a long chain (meth)acrylate polymer as the binder resin.

8. The toner for developing an electrostatic charge image according to any one of the above 1 to 7, wherein the binder resin contains a crystalline resin.

9. The toner for developing an electrostatic charge image according to any one of the above 1 to 8, wherein the crystalline resin has a melting point of from 45 to 80° C.

10. The toner for developing an electrostatic charge image according to any one of the above 1 to 9, wherein the toner further contains a colorant.

11. A process for producing the toner for developing an electrostatic charge image as defined in any one of the above 1 to 10, said toner comprising at least a binder resin and wax, wherein the binder resin is produced via a step of polymerizing a long chain (meth)acrylic acid ester and a vinyl-type monomer, and the ester moiety of the ester contains at least a component having at least 22 carbon atoms.

12. The process for producing the toner for developing an electrostatic charge image according to the above 11, wherein the polymerization step is carried out in the presence of a polymer obtained by polymerizing an ester which is a long chain (meth)acrylic acid ester, of which the ester moiety contains at least a component having at least 18 carbon atoms.

According to the present invention, it is possible to provide a toner for developing an electrostatic charge image, which satisfies both low temperature fixing property and blocking resistance and which is excellent in the fixed image strength and gloss and suitable for use in a high speed printer, and further excellent in the production stability and presents a constant quality, and a process for its production.

BRIEF DESCRIPTION OF DRAWING

FIG. 1 is a schematic diagram showing an example of DSC curves measured by a differential scanning calorimeter.

DETAILED DESCRIPTION OF PREFERRED EMBODIMENTS

The toner of the present invention comprises at least a colorant, a binder resin and wax and may contain an electrification-controlling agent and other additives, as the case requires. Further, the toner of the present invention is preferably produced by a wet method.

The wet method may, for example, be a suspension polymerization method, an emulsion polymerization coagulation method or a melt suspension method.

The suspension polymerization method is usually such that a colorant and wax are dissolved in a binder resin monomer, then such a monomer solution is suspended as monomer droplets in an aqueous medium by a mechanical shearing force, followed by polymerization.

The emulsion polymerization coagulation method is usually a method wherein a polymerizable monomer for a binder resin is emulsified in an aqueous medium containing a polymerization initiator, an emulsifier, etc.; the polymerizable monomer is polymerized with stirring to obtain polymer primary particles; a colorant and, as the case requires, an electrification-controlling agent, etc. are added thereto to coagulate the polymer primary particles; further, the obtained agglomerated particles are aged to produce toner particles.

The melt suspension method is usually such that a binder resin, wax, etc. are dissolved in a solvent to obtain an oil phase; the oil phase is suspended as oil droplets in an aqueous medium; and then, the solvent is removed to obtain a toner.

The toner of the present invention has, in its DSC curve measured by a differential scanning calorimeter, an endothermic peak at least at a temperature of at most 45° C. during its temperature rise at the time of a first temperature rise at a rate of 10° C./min. The first temperature rise means a temperature rise to 120° C. from −20° C. by the DSC curve in a stage before exerting a heat history to the obtained toner. The temperature for the endothermic peak is not particularly limited so long as it is at most 45° C., but is preferably at least 20° C., more preferably at least 25° C. The value of the peak is preferably at least 0.01 mJ/mg, more preferably at least 0.1 mJ/mg, most preferably at least 0.2 mJ/mg and preferably at most 10 mJ/mg, more preferably at most 8 mJ/mg, most preferably at most 5 mJ/mg. If the value is too small, the low temperature fixing property becomes inadequate, and if it is too large, the blocking resistance becomes low. Further, the toner may have, in addition to the above peak, an endothermic peak at a temperature of at least 45° C., and it preferably has an endothermic peak at a temperature of at least 50° C.

The half-value width of the endothermic peak may be too small to measure, but when measurable, the half-value width is preferably at most 10° C., more preferably at most 8° C., most preferably at most 5° C. or too small to measure. If the half-value width is wide, the blocking resistance tends to deteriorate.

In its DSC curve measured by a differential scanning calorimeter, the toner of the present invention preferably has no exothermic peak at a temperature of at most 45° C. during cooling after the first temperature rise and has no endothermic peak at a temperature of at most 45° C. during the second temperature rise. The second temperature rise means a temperature rise to 120° C. from −20° C. by DSC for the second time after cooling to −20° C. after the first temperature rise by DSC. The component showing an endothermic peak at a temperature of at most 45° C. contained in the toner will be compatibilized in the binder resin after heating and shows no exothermic or endothermic peak in the subsequent cooling or the second temperature rise, and thus tends not to bring about a low temperature fixing property or tackiness after the fixing.

In order to let a toner have an endothermic peak at a temperature of at most 45° C., a method is available wherein wax or a crystalline resin having an endothermic peak at a temperature of at most 45° C. is incorporated to the toner. However, there is a problem that by such a method, the blocking resistance of the toner is lowered. Whereas, with the toner of the present invention, it is possible to improve the low temperature fixing property without deteriorating the blocking resistance. The reason is not clearly understood, but the toner of the present invention comprises a crystalline resin and a non-crystalline resin, and a resin showing an exothermic peak at a temperature of at most 45° C. is contained in the binder resin and this resin has a high compatibility with both the crystalline resin and the non-crystalline resin and thus stays in the toner, whereby the low temperature fixing property is considered to be improved without deteriorating the blocking resistance.

As a method for letting the toner have a DSC curve having the above-mentioned specific peak, the "first method" given hereinafter may be mentioned, or a method may also be mentioned wherein in the polymerization treatment of a monomer in the second step, the polymerization treatment is carried out by adding a polymerization initiation after adding a part of the monomer, so that a long chain (meth)acrylic acid ester for a binder is copolymerized with a part of a vinyl-type monomer.

The toner of the present invention may contain a crystalline resin in the binder resin. The crystalline resin is not particularly limited, but the melting point (Tm) of the crystalline resin is preferably at least 45° C., more preferably at least 50° C. and preferably at most 80° C., particularly preferably at most 70° C. If Tm is too low, the blocking resistance tends to deteriorate, and if it is too high, the low temperature fixing property tends to be inadequate.

The method for obtaining the binder resin of the present invention is not particularly limited. However, a method of forming polymer primary particles by polymerizing a long chain (meth)acrylic acid ester and a vinyl-type monomer, may be mentioned as a first method, and this production method is most preferred. To the obtained polymer primary particles, a colorant and, as the case requires, an electrification-controlling agent, etc. are added in the same manner as in a usual emulsification coagulation method, to coagulate the polymer primary particles, and further, the obtained polymer primary particles are aged to produce toner particles.

By obtaining the binder resin of the present invention under the above conditions, it is possible to obtain a toner for developing an electrostatic charge image excellent in the low temperature fixing property and the blocking resistance. The reason is not clearly understood, but it is considered that the effects of the present invention are provided by the following mechanism. That is, the long chain (meth)acrylic acid ester and the vinyl-type monomer are polymerized at the initial stage of the polymerization to form a low melting point component which is considered to be formed by copolymerization of the long chain (meth)acrylic acid ester and the vinyl-type monomer. At that time, such a low melting point component shows a distinct endothermic peak at a temperature of at most 45° C. and becomes a toner excellent in the low temperature fixing property. Further, it is considered that this resin has a low compatibility with the non-crystalline resin and is crystallized in the vicinity of room temperature and at a temperature of at least 45° C., it becomes compatible with the non-crystalline resin and has an effect to lower the viscosity of the non-crystalline resin, whereby the low temperature fixing property is improved without deteriorating the blocking resistance.

As a second method for obtaining the binder resin of the present invention, a method may be mentioned wherein polymer primary particles are formed via a first step of copolymerizing a long chain (meth)acrylic acid ester with a vinyl-type monomer and a second step of copolymerizing a vinyl-type monomer in the presence of the copolymer obtained in the first step, and subsequently, coagulation and aging are carried out as described above to produce toner particles.

The first step is one wherein a monomer (long chain (meth) acrylic acid ester) solution is prepared, this monomer solution is dispersed as oil droplets in an aqueous medium (e.g. an aqueous surfactant solution), and then, this system is subjected to polymerization treatment to prepare a dispersion of polymer primary particles. Further, as the case requires, a crystalline substance such as wax may be dissolved in the monomer to prepare a monomer solution.

The second step is one wherein to the dispersion of the copolymer obtained in the first step, a long chain (meth) acrylic acid ester and a monomer (vinyl-type monomer) are further added, and the monomer is subjected to polymerization treatment in the presence of the copolymer to form polymer primary particles.

The reason as to why an excellent toner for developing an electrostatic charge image is obtainable by such a two step method is not clearly understood, but at the time of polymerizing the vinyl-type monomer, radicals derived from the monomer or the initiator will withdraw a part of tertiary hydrogen at the acrylic acid moiety of the long chain (meth) acrylic acid ester polymer to form a graft polymer. It is considered that this graft polymer serves as a compatibilizing agent and stabilizes the interface between the long chain (meth)acrylic acid ester polymer as a crystalline resin and the vinyl-type polymer, whereby a toner having the long chain (meth)acrylic acid ester polymer dispersed in the vinyl-type copolymer is obtainable, and thus it becomes possible to prepare a toner excellent in the low temperature fixing property and the blocking property.

As a method for producing the binder resin of the toner of the present invention, either the method of polymerizing a long chain (meth)acrylic acid ester and a vinyl-type monomer or the above two step production method may be employed.

With respect to the polymer primary particles obtained by such a method, in their DSC curve measured by a differential scanning calorimeter, the melting point (Tm) of the polymer primary particles during the temperature rise at a rate of 10° C./min is not particularly limited, but is preferably at least 40° C., more preferably at least 50° C. and preferably at most 80° C., particularly preferably at most 70° C. If Tm is too low, the blocking resistance tends to deteriorate, and if it is too high, the low temperature fixing property tends to be inadequate.

Further, with respect to the polymer primary particles, in their DSC curve measured by a differential scanning calorimeter, the crystallization temperature (Tc) of the polymer primary particles during cooling at a rate of 10° C./min is not particularly limited, but is preferably at least 20° C., more preferably at least 30° C. and preferably at most 70° C., particularly preferably at most 60° C.

If Tc is too low, the blocking resistance tends to deteriorate, and if it is too high, the low temperature fixing property tends to be inadequate.

In either production method, the long chain (meth)acrylic acid ester to be used may be linear or branched and may be unsaturated.

In the present invention, the long chain (meth)acrylic acid ester copolymer is not particularly limited, but the average number of carbon atoms in the ester moiety of the long chain (meth)acrylic acid ester is preferably at least 18 to bring the melting point of the toner within the preferred range. Further, it is preferred that at least a component wherein the number of carbon atoms in the ester moiety of the long chain (meth) acrylic acid ester is at least 22, is contained. Further, the component wherein the number of carbon atoms in the ester moiety of the long chain (meth)acrylic acid ester is at least 22, is preferably at least 1 mass %, more preferably at least 5 mass %, particularly preferably at least 10 mass %, or may be 100 mass %, of the long chain (meth)acrylic acid ester, whereby the melting point of the toner tends to be within the preferred range.

Further, in the long chain (meth)acrylic acid ester copolymer of the present invention, a component wherein the number of carbon atoms in the ester moiety of the long chain (meth)acrylic acid ester monomer is at least 12, is preferably at least 50 mass %, such being preferred for the optimization of the melting point of the toner by crystallization. If the number of carbon atoms in the ester moiety is too small, the melting point tends to be low, and the blocking resistance tends to be poor.

The number of carbon atoms in the ester moiety of the long chain (meth)acrylic acid ester can be measured by DSC, NMR or by hydrolyzing the ester moiety, followed by measurement by GC, LC or the like.

Further, in the long chain (meth)acrylic acid ester copolymer of the present invention, it is preferred that at least a long chain acrylic acid ester is contained. When a long chain acrylic acid ester is contained, a graft polymer is likely to be readily formed by withdrawal of the tertiary hydrogen, and the compatibility with other polymers tends to be increased, whereby a uniform toner tends to be obtainable.

The long chain (meth)acrylic acid ester to be used in the present invention may, for example, be octadecyl acrylate, icosyl acrylate, octadecyl methacrylate, icosyl methacrylate, docosyl acrylate, tetracosyl acrylate, hexacosyl acrylate, octacosyl acrylate, docosyl methacrylate, tetracosyl methacrylate, hexacosyl methacrylate or octacosyl methacrylate.

As the binder resin of the present invention, a copolymer obtained by polymerizing a plurality of monomers other than the above-described long chain (meth)acrylic acid ester, may be employed.

As a monomer, any polymerizable monomer may be used, such as a polymerizable monomer having an acidic group (hereinafter sometimes referred to simply as an acidic monomer), a polymerizable monomer having a basic group (hereinafter sometimes referred to simply as a basic monomer) or a polymerizable monomer having no acidic or basic group (hereinafter sometimes referred to as another monomer). However, a vinyl-type monomer is preferred, since it is thereby possible to obtain a toner excellent in the low temperature fixing property and blocking resistance.

Such a monomer may, for example, be a polymerizable monomer having a carboxy group such as acrylic acid, methacrylic acid, maleic acid, fumaric acid or cinnamic acid, a polymerizable monomer having a sulfonate group such as styrene sulfonate, or a polymerizable monomer having a sulfonamide group such as a vinylbenzene sulfonamide. Whereas, a basic monomer may, for example, be an aromatic vinyl compound having an amino group, such as aminostyrene, a nitrogen-containing hetero ring-containing polymerizable monomer such as vinylpyridine or vinylpyrrolidone, or a (meth)acrylic acid ester having an amino group, such as dimethylaminoethyl acrylate or diethylaminoethyl methacrylate. These acidic monomers and basic monomers may be used alone, or a plurality of them may be used as mixed. Otherwise, they may be present in the form of a salt with a counter ion. It is particularly preferred to employ an acidic monomer and more preferred to employ acrylic acid and/or methacrylic acid.

Further, other polymerizable monomers may, for example, be a styrene such as styrene, methylstyrene, chlorostyrene, dichlorostyrene, p-tert-butylstyrene, p-n-butylstyrene or p-n-nonylstyrene, an acrylic acid ester such as methyl acrylate, ethyl acrylate, propyl acrylate, n-butyl acrylate, isobutyl acrylate, hydroxyethyl acrylate or 2-ethylhexyl acrylate, a methacrylic acid ester such as methyl methacrylate, ethyl methacrylate, propyl methacrylate, n-butyl methacrylate, isobutyl methacrylate, hydroxyethyl methacrylate or 2-ethylhexyl methacrylate, acrylamide, N-propylacrylamide, N,N-dimethylacrylamide, N,N-dipropylacrylamide, and N,N-dibutylacrylamide. Such polymerizable monomers may be used alone, or a plurality of them may be used in combination.

Further, in a case where the binder resin is made to be a crosslinkable resin, together with the above-described polymerizable monomers, a radical-polymerizable polyfunctional monomer is used, such as, divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol diacrylate or diallyl phthalate. Further, it is also possible to use a polymerizable monomer having a reactive group in a pendant group, such as glycidyl methacrylate, methylol acrylamide or acrolein. Among them, a radical-polymerizable bifunctional polymerizable monomer is preferred, and divinylbenzene or hexanediol diacrylate is particularly preferred. These polyfunctional polymerizable monomers may be used alone, or a plurality of them may be used as mixed.

In the present invention, the melting point of the polymer of the long chain (meth)acrylic acid ester obtained in the first step is preferably at most 100° C., more preferably at most 80° C., particularly preferably at most 70° C. On the other hand, the melting point is preferably at least 40° C., more preferably at least 50° C. If the melting point is too high, the effect to lower the fixing temperature tends to be poor, and if the melting point is too low, there may be a problem with respect to the solidification or storage stability.

The storage elastic modulus at 100° C. of the long chain (meth)acrylic acid ester copolymer to be used in the present invention is preferably at most $10^5$ Pa, more preferably at most $10^4$ Pa. If the storage elastic modulus is too high, the low temperature fixing effect may not be obtainable.

When the second step of the present invention is carried out, the long chain (meth)acrylic acid ester polymer to be supplied to the second step is charged in an amount of preferably at least 1 part by mass, more preferably at least 2 parts by mass, further preferably at least 5 parts by mass, in 100 parts by mass of the binder resin. Further, it is charged in an amount of at most 50 parts by mass, more preferably at most 45 parts by mass, further preferably at most 40 parts by mass, in 100 parts by mass of the binder resin. If the content of the long chain (meth)acrylic acid ester polymer in the binder resin is too small, the performance of e.g. the low temperature fixing property may not be sufficient, and if it is too large, the fixed image strength tends to deteriorate, and there may be a case where an image defect is formed by bending or scratching.

However, in a case where the polymerization reaction in the second step is adjusted so that the toner has, in its DSC curve, an endothermic peak of from 0.01 to 10 mJ/mg at a temperature of at most 45° C. during its temperature rise, the amount of the long chain (meth)acrylic acid ester polymer to be supplied from the first step to the second step may be made to be 0. Such a case corresponds to the above-described "first method" wherein the polymer primary particles are formed by polymerizing a long chain (meth)acrylic acid ester and a vinyl-type monomer. This "first method" is preferred in that the first step can be omitted.

The polymerization time in the first step of the present invention is not particularly limited. However, it is preferred to carry out the polymerization until the monomer remaining after the polymerization becomes less than 1 mass %. It is usually at least 5 minutes and at most 3 hours, and the polymerization is preferably carried out at a temperature of at least the melting point of the monomer supplied to the first step.

The long chain (meth)acrylic acid ester to be supplied to the first step as a step for producing the binder resin of the present invention, may preferably be melted and then mixed with water and a surfactant, etc., as the case requires, followed by high pressure mechanical emulsification. The high pressure mechanical emulsification may be carried out together with wax. By carrying out the high pressure mechanical emulsification, it is possible to reduce the size of the dispersion element of wax or the long chain (meth)acrylic acid ester. As the size of the dispersion element before polymerization becomes small, the specific surface area of the dispersion element becomes large, whereby the graft reaction tends to readily proceed.

In the present invention, the volume average particle diameter of the dispersion element of wax or the long chain (meth) acrylic acid ester is preferably at least 0.03 μm, more preferably at least 0.05 μm, particularly preferably at least 0.1 μm and preferably at most 2 μm, further preferably at most 1 μm, particularly preferably at most 0.5 μm.

The apparatus to be used for the high pressure mechanical emulsification to be used in the present invention is not particularly limited, but it is preferred to employ an apparatus whereby a pump pressure is at least 5 MPa, preferably at least 10 MPa.

Further, in the high pressure mechanical emulsification, it is preferred to carry out emulsification at a temperature of at least the melting point of the wax and the long chain (meth) acrylic acid ester. If the emulsification temperature is too low, the particle diameter of the dispersion element tends to be hardly reduced.

The long chain (meth)acrylic acid ester to be supplied to the second step as a step for producing the binder resin of the present invention, may be the same as or different from the long chain (meth)acrylic acid ester supplied to the first step. Further, like the long chain (meth)acrylic acid ester supplied in the first step, it may preferably be melted and then mixed with water and a surfactant, etc., as the case requires, followed by high pressure mechanical emulsification. Such high pressure mechanical emulsification may be carried out together with wax.

As the vinyl-type monomer to be supplied to the second step as the step for producing the binder resin of the present invention, a monomer which has been commonly used for the binder resin of the toner may suitably be used.

The polymerization time in the second step of the present invention may suitably be adjusted by e.g. the method of adding the monomer, the emulsifier, etc. to be supplied to the second step and is not particularly limited, but it is preferred to carry out the polymerization until the monomer remaining after the polymerization will be less than 1 mass %. Further, the polymerization is preferably carried out at a temperature of at least the melting point of the polymer obtained in the first step.

The long chain (meth)acrylic acid ester polymer to be supplied to the first step of the present invention is contained in an amount of at most 50 parts by mass, more preferably at most 45 parts by mass, particularly preferably at most 40 parts by mass and preferably at least 1 part by mass, more preferably at least 2 parts by mass, particularly preferably at least 5 parts by mass, per 100 parts by mass of the binder resin.

If the polymer content is too small, the low temperature fixing property of the toner may not be obtainable, and if it is too large, the fixed strength of the toner tends to deteriorate, and there may be a case where an image defect is formed by bending or scratching.

The long chain (meth)acrylic acid ester polymer to be supplied to the second step of the present invention is contained in an amount of preferably at most 10 parts by mass, more preferably at most 8 parts by mass, most preferably at most 5 parts by mass and preferably at least 0.5 part by mass, more preferably at least 1 part by mass, particularly preferably at least 1.5 parts by mass, per 100 parts by mass of the binder resin.

If the polymer content is too small, the low temperature fixing property of the toner may not be obtainable, and if it is too large, the blocking resistance of the toner tends to deteriorate.

In the present invention, the polymerization initiator to be used in the step for producing the binder resin is not particularly limited in the first step and the second step, and a known polymer initiator may be used, as the case requires. One initiator may be used alone, or two or more initiators may be used in combination. The polymerization initiator may be a radical polymerization initiator or an ion polymerization initiator, but a radical polymerization initiator is preferred in use in water, and when it is used in the second step to obtain the binder resin, the graft reaction by withdrawing hydrogen tends to readily take place, such being particularly preferred.

As the radical polymerization initiator, an organic polymerization initiator and an inorganic polymerization initiator are available, but hydrogen peroxide and an organic polymerization initiator are preferably employed. An inorganic polymerization initiator such as potassium persulfate, sodium persulfate or ammonium persulfate may sometimes be required to be used in a large amount, whereby hydrophilic groups tend to be formed at polymer terminals, which tends to adversely affect the electrification properties.

Especially, as hydrogen peroxide and an organic polymerization initiator, in the second step to obtain a binder resin, ketone peroxide, and hydroperoxide containing hydrogen peroxide, are preferred whereby the graft reaction by withdrawing hydrogen tends to readily take place. Further, hydroperoxide containing hydrogen peroxide is most preferred.

Such a polymerization initiator may be added to the polymerization system at any time i.e. before, during or after the addition of the monomers, and if necessary, these methods for addition may be used in combination.

In the present invention, a known chain transfer agent may be used as the case requires. Specific examples of such a chain transfer agent include t-dodecyl mercaptan, 2-mercaptoethanol, diisopropylxanthogen, carbon tetrachloride and trichlorobromomethane. Such chain transfer agents may be used alone or in combination as a mixture of two or more of them. Such a chain transfer agent may be used in an amount of from 0 to 5 mass % based on the polymerizable monomers.

In the present invention, a known suspension stabilizer may be used as the case requires. Specific examples of such a suspension stabilizer include potassium phosphate, magnesium phosphate, calcium hydroxide and magnesium hydroxide. They may be used alone or in combination as a mixture of two or more of them. The suspension stabilizer may be used in an amount of at least one part by mass and at most 10 parts by mass, per 100 parts by mass of the polymerizable monomers.

Each of the polymerization initiator and the suspension stabilizer may be added to the polymerization system at any time i.e. before, during or after the addition of the polymerizable monomers, and if necessary, these methods for addition may be used in combination.

Further, to the reaction system, a pH-controlling agent, a polymerization degree-controlling agent, a defoaming agent, etc. may suitably be added.

In the present invention, in a case where a binder resin is prepared by emulsion polymerization, a known emulsifier may be used as the emulsifier. As such an emulsifier, one or more emulsifier selected from a cationic surfactant, an anionic surfactant and a nonionic surfactant may be used.

The cationic surfactant may, for example, be dodecylammonium chloride, dodecylammonium bromide, dodecyltrimethylammonium bromide, dodecylpyridinium chloride, dodecylpyridinium bromide or hexadecyltrimethylammonium bromide, and the anionic surfactant may, for example, be a fatty acid soap such as sodium stearate or sodium dodecanoate, sodium dodecylsulfate, sodium dodecylbenzenesulfonate or sodium laurylsulfate. The nonionic surfactant may, for example, be polyoxyethylene dodecyl ether, polyoxyethylene hexadecyl ether, polyoxyethylene nonylphenyl ether, polyoxyethylene lauryl ether, polyoxyethylene sorbitan monooleate ether or monodecanoyl sucrose.

The amount of the emulsifier in the present invention is preferably at least 0.1 part by mass and at most 10 parts by mass, per 100 parts by mass of the polymerizable monomers. Further, together with such an emulsifier, one or more of polyvinyl alcohols such as partially or completely saponified polyvinyl alcohols, and cellulose derivatives such as hydroxyethyl cellulose, may be used in combination as protective colloid.

The volume average particle diameter of primary particles of the polymer after multistage polymerization obtained by emulsion polymerization is usually at least 0.03 μm, preferably at least 0.05 μm, more preferably at least 0.1 μm, and usually at most 3 μm, preferably at most 2 μm, more preferably at most 1 μm. If the particle diameter is too small, control of the coagulation rate is likely to be difficult in the coagulation step, and if it is too large, the particle diameter of toner particles obtained by coagulation tends to be large, and it is likely to be difficult to obtain a toner having the desired particle diameter.

As the wax to be used for the toner of the present invention, a known wax may be optionally used. Specifically, it may, for example, be an olefin wax such as a low molecular weight polyethylene, a low molecular weight polypropylene or a copolymer polyethylene; paraffin wax; an ester type wax having a long chain aliphatic group, such as behenyl behenate, a montanate or stearyl stearate; a vegetable wax such as hydrogenated castor oil or carnauba wax; a ketone having a long chain alkyl group such as distearylketone; a silicone having an alkyl group; a higher fatty acid such as stearic acid; a long chain aliphatic alcohol; a long chain fatty acid polyhydric alcohol such as pentaerythritol and its partial ester; or a higher fatty acid amide such as oleic amide or stearic amide; preferably a hydrocarbon type wax such as paraffin wax or Fischer-Tropsch wax, an ester type wax or a silicone type wax.

In the present invention, a hydrocarbon type wax is preferred, since it has low compatibility with a resin which is commonly used as a binder resin for a toner, obtainable by a polymerization method. If a wax having too high compatibility with the binder resin is used, such wax is dissolved in the resin to change the resin characteristics thereby to adversely affect the performance of the toner such that it becomes difficult to satisfy both the fixing property and the blocking resistance, or the image quality is deteriorated by exposure of the wax on the toner surface or freeing of the wax of the toner.

In the present invention, such waxes may be used alone or in combination as a mixture. Further, in order to improve the fixing property, the melting point of wax is preferably at most 110° C., more preferably at most 90° C., particularly preferably at most 80° C. The lower limit of the melting point is preferably at least 40° C., more preferably at least 50° C. If the melting point is too high, the effect to lower the fixing temperature tends to be poor, and if the melting point is too low, there may be a problem with respect to the solidification or storage stability.

In the present invention, the amount of wax is preferably at least 1 part by mass, more preferably at least 2 parts by mass, further preferably at least 5 parts by mass, per 100 parts by mass of the toner. Further, it is preferably at most 40 parts by mass, more preferably at most 35 parts by mass, further preferably at most 30 parts by mass. If the wax content in the toner is too low, the performance such as the high temperature offset may not be sufficient, and if it is too high, the blocking resistance tends to be inadequate, or wax tends to leach out from the toner to soil the apparatus.

As the colorant of the present invention, a known colorant may optionally be used. Specific examples of the colorant include carbon black, aniline blue, phthalocyanine blue, phthalocyanine green, hansa yellow, rhodamine type dye or pigment, chromium yellow, quinacridone, benzidine yellow, rose bengal, a triallylmethane dye, a monoazo-, disazo-, or condensed azo-dye or pigment, etc. Such known optional dyes and pigments may be used alone or as mixed. In the case of a full color toner, as a yellow colorant, benzidine yellow, or a monoazo- or condensed azo-dye or pigment is preferably employed, as a magenta colorant, quinacridone, or a monoazo-dye or pigment is preferably employed, and as a cyan colorant, phthalocyanine blue is preferably employed. The colorant is preferably used in an amount of at least 3 parts by mass and at most 20 parts by mass, per 100 parts by mass of the polymer primary particles.

In the emulsion polymerization coagulation method, the colorant is incorporated usually in the coagulation step. A dispersion of polymer primary particles and a dispersion of colorant particles are mixed to obtain a mixed dispersion, which is coagulated to obtain agglomerates of particles. The colorant is preferably used in a state as dispersed in water in the presence of an emulsifier, and the volume average particle diameter of the colorant particles is preferably at least 0.01 μm, more preferably at least 0.05 μm and preferably at most 3 μm, more preferably at most 1 μm.

In the present invention, when an electrification-controlling agent is to be employed, known optional ones may be used alone or in combination. For example, a positively chargeable electrification-controlling agent may, for example, be a quaternary ammonium salt or a basic electron donative metal material, and a negatively chargeable electrification-controlling agent may, for example, be a metal chelate, a metal salt of an organic acid a metal-containing dye, a nigrosine dye, an amide group-containing compound, a phenol compound, a naphthol compound or a metal salt thereof, a urethane bond-containing compound, or an acidic or electron attractive organic material.

Further, in a case where the toner for developing an electrostatic charge image obtainable by the production method of the present invention is used as a toner other than a black color toner in a color toner or full color toner, it is preferred to employ an electrification-controlling agent which is free from presenting a coloring trouble to a colorless or pale color toner. For example, as a positively chargeable electrification-controlling agent, a quaternary ammonium salt compound is preferred, and as a negative chargeable electrification-controlling agent, a metal salt or metal complex of salicylic acid or alkyl salicylic acid with e.g. chromium, zinc or aluminum, a metal salt or metal complex of benzylic acid, an amide compound, a phenol compound, a naphthol compound, a phenolamide compound or a hydroxynaphthalene compound such as 4,4'-methylenebis[2-[N-(4-chlorophenyl)amide]-3-hydroxynaphthalene] is preferred.

In the present invention, in a case where an electrification-controlling agent is to be incorporated to the toner by an emulsion polymerization coagulation method, the electrification-controlling agent may be added together with polymerizable monomers, etc. during the emulsion polymerization, or it may be added in the coagulation step together with the polymer primary particles, the colorant, etc., or it may be blended by a method of adding it after the polymer primary particles, the colorant, etc. are coagulated to have substantially the desired particle diameter. It is particularly preferred to disperse the electrification-controlling agent in water by means of a surfactant to obtain a dispersion with a volume average particle diameter of at least 0.01 μm and at most 3 μm, which is then added in the coagulation step.

The toner of the present invention may be produced by any polymerization method such as a suspension polymerization method, an emulsion polymerization coagulation method or a solution suspension method and is not particularly limited.

In the production method by an emulsion polymerization coagulation method, primary particles of polymers obtained by emulsion polymerization of binder resin monomers, a colorant dispersion, a wax dispersion, etc. are preliminarily prepared, and they are dispersed in an aqueous medium, followed by heating, etc. to carry out a coagulation step and further an aging step. Agglomerated particles thus aged are washed and collected by filtration and dried to obtain toner matrix particles. Further, as the case requires, additives may be added to obtain a toner.

The polymer primary particles are used usually in the form of a dispersion as they are dispersed by a surfactant in water or a liquid composed mainly of water. However, in a case where an antistatic agent is added after coagulation treatment, it is preferred to add the polymer primary particles after adding the antistatic agent to a dispersion containing agglomerates of particles.

In the emulsion polymerization coagulation method, coagulation is usually carried out in a tank provided with a stirring device, and it may be carried out by a heating method, a method of adding an electrolyte, or a combination of these methods.

In a case where polymer primary particles are coagulated with stirring in order to obtain agglomerates of particles having a desired size, the size of agglomerates of particles is controlled by the balance between the coagulation force among particles and the shearing force by the stirring, and the coagulation force can be increased by heating or by adding an electrolyte.

In a case where coagulation is carried out by adding an electrolyte in the present invention, such an electrolyte may be an organic salt or an inorganic salt. Specifically, it may, for example, be NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$ or $C_6H_5SO_3Na$. Among them, an inorganic salt having a bivalent or higher valent metal cation is preferred.

In the present invention, the amount of the electrolyte varies depending upon the type of the electrolyte, the desired particle diameter, etc., but it is preferably at least 0.05 part by mass, more preferably at least 0.1 part by mass, per 100 parts by mass of the solid component of the mixed dispersion. Further, it is preferably at most 25 parts by mass, more preferably at most 15 parts by mass, particularly preferably at most 10 parts by mass. If the amount is too small, the progress of the coagulation reaction tends to be slow, whereby there may be a problem such that a fine powder of 1 μm or less remains after the coagulation reaction, or the average particle diameter of agglomerates of particles thereby obtained does not reach the desired particle diameter. On the other hand, if it is too large, the coagulation tends to be rapid, whereby there may be a problem such that control of the particle diameter becomes difficult, or coarse particles or irregular particles tend to be contained in the obtained coagulated particles. The coagulation temperature in the case of carrying out the coagulation by adding an electrolyte, is preferably at least 20° C., more preferably at least 30° C. and preferably at most 70° C. or more preferably at most 60° C.

In a case where the coagulation is carried out only by heating without using an electrolyte, the coagulation temperature is preferably at least (Tg-20)° C., more preferably at least (Tg-10)° C., where Tg is the glass transition temperature of the polymer primary particles. Further, it is preferably at most Tg, more preferably at most (Tg-5)° C.

The time required for the coagulation is optimized by the shape of the apparatus or the treatment scale. However, in order to bring the particle diameter of the toner to the desired particle diameter, it is usually preferred to maintain the system at the above prescribed temperature for at least 30 minutes. The temperature may be raised to the prescribed temperature at a constant rate or stepwise.

To the surface of agglomerates of particles after the above coagulation treatment, fine resin particles may be attached or fixed, as the case requires. By attaching or fixing fine resin particles having the properties controlled, to the surface of agglomerates of particles, it may be possible to improve the electrostatic property or the thermal resistance of the obtainable toner and further to increase the effects of the present invention.

It is preferred to employ, as the fine resin particles, ones having a glass transition temperature higher than the glass transition temperature of the polymer primary particles, whereby it is possible to realize a further improvement of the blocking resistance without impairing the fixing property. The volume average particle diameter of the fine resin particles is preferably at least 0.02 μm, more preferably at least 0.05 μm and preferably at most 3 μm, more preferably at most 1.5 μm. As such fine resin particles, it is possible to employ ones obtainable by emulsion polymerization of the same monomer as the polymerizable monomer to be used for the above-described polymer primary particles.

The fine resin particles are usually employed in the form of a dispersion as dispersed in water or a liquid containing water as the main component, by means of a surfactant. In a case where an electrification-controlling agent is added after the coagulation treatment, it is preferred to add the fine resin particles after adding the electrification-controlling agent to the dispersion containing agglomerates of particles.

In order to increase the stability of the agglomerates of particles obtained in the coagulation step, it is preferred to carry out fusion among agglomerated particles in an aging step after the coagulation step. The temperature in the aging step is preferably at least Tg of the polymer primary particles, more preferably at least a temperature higher by 5° C. than Tg and preferably at most a temperature higher by 80° C. than Tg, more preferably at most a temperature higher by 50° C. than Tg. Further, the time required for the aging step varies depending upon the desired shape of the toner, but it is usually from 0.1 to 10 hours, preferably from 1 to 6 hours, after the temperature has reached at least the glass transition temperature of the polymer primary particles.

Further, after the coagulation step, preferably before the aging step or during the aging step, it is preferred to add a surfactant or to increase the pH value. As the surfactant to be used here, at least one member may be selected for use from emulsifiers which may be used at the time of producing the polymer primary particles, but it is particularly preferred to employ the same emulsifier as the one used for the production of the polymer primary particles. In the case of adding the surfactant, the amount is not particularly limited but is preferably at least 0.1 part by mass, more preferably at least 1 part by mass, further preferably at least 3 parts by mass and preferably at most 20 parts by mass, more preferably at most 15 parts by mass, more preferably at most 10 parts by mass, per 100 parts by mass of the solid component in the mixed dispersion. By adding the surfactant or increasing the pH value after the coagulation step and before completion of the aging step, it may be possible to suppress e.g. aggregation of agglomerates of particles coagulated in the coagulation step and to suppress formation of coarse particles after the aging step.

By heat treatment in the aging step, fusion and integration among polymer primary particles are carried out in the agglomerates, whereby the shape of the toner particles as the agglomerates becomes close to a spherical shape. Agglomerates of particles before the aging step are considered to be coagulated by electrostatic or physical coagulation of polymer primary particles, but after the aging step, polymer primary particles constituting the agglomerates of particles are considered to be mutually fused, and the shape of the toner particles can be made to be close to a spherical shape. By such an aging step, by controlling the temperature, time, etc. of the aging step, it is possible to produce a toner having various shapes depending upon the particular purpose, such as a grape type as a shape having polymer primary particles agglomerated, a potato type having the fusion advanced or spherical shape having the fusion further advanced.

The toner produced by a polymerization method is separated from the aqueous solvent, washed and dried, and if necessary, subjected to additive treatment, etc. to be used as a toner for developing an electrostatic charge image.

As the liquid to be used for washing, water is employed, but it is also possible to carry out washing with an aqueous solution of an acid or alkali, and it is preferred to employ an inorganic acid such as nitric acid, hydrochloric acid or sulfuric acid, or an organic acid such as citric acid. Otherwise, washing may be carried out with warm water or hot water, and these methods may be used in combination. By such a washing step, it is possible to reduce or remove a suspension stabilizer, emulsifier, unreacted remaining monomers, etc. such being desirable. In the washing step, it is preferred to repeat an operation such that the liquid to be washed is subjected to e.g. filtration or decantation to obtain a concentrated slurry or wet cake of colored particles, to which a fresh washing liquid is added to disperse the toner. The colored particles after washing are preferably recovered in the form of a wet cake from the viewpoint of the handling efficiency in the subsequent drying step.

In the drying step, a flow drying method such as vibration type flow drying method or a circulation type flow drying method, a flash drying method, a vacuum drying method, a freeze drying method, a spray drying method or a flash jet method may, for example, be used. The operation conditions such as the temperature, air flow rate, vacuum degree, etc. in the drying step are suitably optimized based on e.g. Tg of the colored particles, the shape, mechanism and size of the apparatus, etc.

The volume median diameter of toner matrix particles of the present invention is preferably at least 3 μm, more preferably at least 4 μm and preferably at most 10 μm, more preferably at most 9 μm, further preferably at most 7 μm.

Further, with respect to the shape, the average circularity as measured by means of a flow type particle image analyzer FPIA-3000 is preferably at least 0.90, more preferably at least 0.92, further preferably at least 0.94 and preferably at most 0.99, more preferably at most 0.98. If the average circularity is too low, deterioration in electrification or deterioration in the image density is likely to occur due to inferior attachment of the additive to the colored particles, and if it is too high, cleaning is likely to be inferior due to the shape of colored particles.

To the toner of the present invention, fine additive particles may be added, as the case requires, in order to improve the flowability of the toner or to improve the electrification-controlling property. Such fine additive particles may suitably be selected for use among various inorganic or organic fine particles.

As such fine inorganic particles, it is possible to employ, for example, various carbides such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide, etc., various nitrides such as boron nitride, titanium nitride, zirconium nitride, etc., various borates such as zirconium borate, etc., various oxides such as titanium oxide, calcium oxide, magnesium oxide, zinc oxide, copper oxide, aluminum oxide, cerium oxide, silica, colloidal silica, etc., various titanate compounds such as calcium titanate, magnesium titanate, strontium titanate, etc., a phosphate compound such as calcium phosphate, a sulfide such as molybdenum disulfide, a fluoride such as magnesium fluoride or carbon fluoride, various metal soaps such as aluminum stearate, calcium stearate, zinc stearate, magnesium stearate, etc., talc, bentonite, various carbon blacks or conductive carbon blacks, magnetite, ferrite etc. As fine organic particles, it is possible to use fine particles of a styrene type resin, an acrylic resin, an epoxy type resin, a melamine type resin, etc.

Among these fine additive particles, silica, titanium oxide, alumina, zinc oxide, various carbon blacks or conductive carbon blacks are, for example, particularly preferably used. Further, as the fine additive particles, it is also possible to use ones having surface treatment such as hydrophobizing treatment applied to the surface of the above-mentioned inorganic or organic fine particles with a treating agent such as a silane coupling agent, a titanate-type coupling agent, silicone oil, modified silicone oil, silicone varnish, a fluorinated silane coupling agent, fluorinated silicone oil or a coupling agent having an amino group or a quaternary ammonium salt group. Two or more of such treating agents may be used in combination.

The fine additive particles of the present invention preferably have an average particle diameter of at least 0.001 μm, more preferably at least 0.005 μm and preferably at most 3 μm, more preferably at most 1 μm. Further, plural types having different particle diameters may be blended for use. The average particle diameter of the fine additive particles can be obtained by an electron microscopic observation.

Further, as the fine additive particles, two or more different types may be used in combination, and it is possible to use surface-treated ones and surface-non-treated ones in combination or to use those having different surface treatments applied in combination. Or, positively chargeable ones and negatively chargeable ones may be suitably combined for use.

The content of the fine additive particles of the present invention is preferably at least 0.01 part by weight, more preferably at least 0.1 part by weight and preferably at most 5 parts by weight, more preferably at most 3 parts by weight, per 100 parts by mass of the toner particles.

The method for adding the fine additive particles may, for example, be a method of using a high speed stirrer such as a HENSCHEL MIXER, or a method by means of a device capable of exerting a compression shearing stress.

Further, it is possible to add fine inorganic powder or the like of magnetite, ferrite, cerium oxide, strontium titanate, conductive titania or the like. The amount of such an additive may suitably be selected depending upon the desired performance, and it is preferably at least 0.05 part by mass and at most 10 parts by mass, per 100 parts by mass of the toner.

The melting point (Tm) of the toner after adding such additives of the present invention is preferably at most 80° C., more preferably at most 70° C. and preferably at least 40° C., more preferably at least 50° C. When the melting point is within such a range, it is more likely that it is possible to satisfy both the low temperature fixing and the blocking resistance.

The toner for developing an electrostatic charge image obtainable by the process of the present invention may be used in any form of a two component developer wherein the toner is used together with a carrier, or a magnetic or non-magnetic one component developer wherein no carrier is used. When it is used as a two component developer, as the carrier, it is possible to use a known one such as a magnetic material such as an iron-powder, a magnetite powder or a ferrite powder, or one having a resin coating applied to the surface of such a magnetic material, or a magnetic carrier. As a coating resin for a resin-coated carrier, it is possible to employ a styrene type resin, an acrylic resin, a styrene acrylic copolymer type resin, a silicone resin, a modified silicone resin, a fluorinated resin or a mixture thereof, which is commonly known.

EXAMPLES

Now, the present invention will be described in further detail with reference to Examples, but it should be understood that the present invention is by no means restricted to the following Examples. In the following Examples, "parts" means "parts by mass".

Various particle diameters and circularity, thermal properties, etc. were measured as follows.

<Measurement of Volume Average Diameter (MV)>

The volume average diameter (MV) of particles having a volume average diameter (MV) of less than 1 μm was measured by Microtrac Nanotrac 150 (hereinafter referred to simply as Nanotrac) manufactured by Nikkiso Co., Ltd. and an analysis soft Microtrac Particle Analyzer Ver 10.1.2-019EE of the same company, by the method disclosed in the handling manual, by using ion exchanged water having an electrical conductivity of 0.5 μS/cm as the solvent under the measuring conditions of solvent refractive index: 1.333, measuring time: 600 sec and measuring time: once. Other conditions set were particle refractive index: 1.59, permeability: permeable, shape: spherical, and density: 1.04.

<Measurement of Volume Median Diameter (Dv50)>

The volume media diameter (Dv50) of particles having a volume median diameter (Dv50) of at least 1 μm was measured by using Multisizer III (aperture diameter: 100 μm, hereinafter referred to simply as Multisizer) manufactured by Beckman Coulter, Inc. by using as a dispersion medium Isoton II manufactured by the same company and dispersing the particles so that the dispersoid concentration became 0.03%.

<Average Circularity>

The "average circularity" in the present invention is measured as follows and defined as follows. That is, the toner matrix particles are dispersed in a dispersion medium (CELLSHEATH, manufactured by Sysmex) so that their concentration becomes within a range of from 5,720 to 7,140 particles/μL, and measured by means of a flow type particle image analyzer (FPIA3000, manufactured by Sysmex) under the following conditions, and the obtained value is defined as the "average circularity". In the present invention, the same measurement is repeated three times, and the arithmetic average value of the three "average circularity" is adopted as the "average circularity":

Mode: HPF

HPF analytical amount: 0.35 μL

HPF detection number: from 8,000 to 10,000 particles

The following is one which is measured by the above analyzer and automatically calculated and shown in the above analyzer, and "circularity" is defined by the following formula.

[Circularity]=[Circumferential length of circle having the same area as the projected area of a particle]/[Circumferential length of the projected image of the particle]

And, from 8,000 to 10,000 particles as the LPF detection number are measured, and the arithmetic mean (arithmetic average) of circularity of such individual particles is shown in the analyzer as the "average circularity".

<Thermal Characteristics>

Using a thermal analysis equipment DSC220CU manufactured by Seico Electronics Industrial Co., Ltd. and in accordance with the method disclosed in the handling manual of the same company, as the first temperature rise, the temperature was raised from −20° C. to 120° C. at a rate of 10° C./min, then as the first cooling, the temperature was lowered from 120° C. to −20° C. at a rate of 10° C./min, and then as the second temperature rise, the temperature was raised from −20° C. to 120° C. at a rate of 10° C./min. From a DSC curve obtained at that time, the peak half-value width was measured by means of an analytical software attached to the equipment. In a case where a plurality of peaks were present, the highest peak was taken as the melting point of the toner.

<Weight Average Molecular Weight (Mw)>

A THF-soluble component of the polymer primary particle dispersion was measured by gel permeation chromatography (GPC) under the following conditions.

Apparatus: GPC apparatus HLC-8020 manufactured by Tosoh Corporation, column: PL-gel Mixed-B 10μ manufactured by Polymer laboratory, solvent: THF, sample concentration: 0.1 mass %, calibration curve: standard polystyrene <Loss Elastic Modulus and Storage Elastic Modulus of Toner>

The loss elastic modulus and storage elastic modulus of a toner were measured under the following conditions.

Apparatus: ARES manufactured by TA Instruments Japan, temperature condition: raised from 30° C. to 200° C. at a rate of 4° C./min, plate: parallel plate (diameter: 8 mm), frequency: 1 Hz, initial value of measured strain: 0.1%, measured sample: about 0.25 g of a toner was molded into a cylindrical sample having a diameter of about 8 mm and a height of about 5 mm by means of a hot press machine (50° C., 10 kg, 5 min).

Example 1

Preparation of Emulsified Liquid A1

100 Parts of behenyl acrylate, 100 parts of stearyl acrylate, 22 parts of a 20% sodium dodecylbenzene sulfonate aqueous solution (Neogen S20D manufactured by Dai-ichi Kogyo Seiyaku Co., Ltd., hereinafter referred to simply as "20% DBS aqueous solution) and 828 parts of deionized water were heated to 90° C. and stirred for 10 minutes by means of a homomixer (Model Mark IIf manufactured by Tokushu Kika Kogyo). Then, under heating at 90° C., by means of a high pressure emulsification equipment (Model LAB60-10TBS manufactured by APV Gaulin), circulation emulsification was initiated under a pressure condition of 20 MPa, and the particle diameter was measured by Nanotrac, and the particles were dispersed until the volume average particle diameter (MV) became at most 500 nm to prepare emulsified liquid A1. The fine particle diameter (MV) was 277 nm.

<Preparation of Emulsified Liquid A2>

Emulsified liquid A2 was prepared in the same manner as A1 except that the composition was changed to 100 parts of paraffin wax (HNP-9 manufactured by Nippon Seiro Co., Ltd., melting point: 82° C.), 6.91 parts of stearyl acrylate, 3.3 parts of decaglycerin decabehenate (acid value: 3.2, hydroxy value: 27), 7.1 parts of a 20% DBS aqueous solution and 255.9 parts of deionized water. The final particle diameter (MV) was 225 nm.

<Preparation of Emulsified Liquid A3>

Emulsified liquid A3 was prepared in the same manner as A1 except that the composition was changed to 100 parts of behenyl acrylate, 11 parts of a 20% DBS aqueous solution and 414 parts of deionized water. The final particle diameter (MV) was 240 nm.

<Preparation of Emulsified Liquid A4>

Emulsified liquid A4 was prepared in the same manner as A1 except that the composition was changed to 100 parts of stearyl acrylate, 11 parts of a 20% DBS aqueous solution and 414 parts of deionized water. The final particle diameter (MV) was 200 nm.

<Preparation of Polymer Primary Particle Dispersion C1>

<First Step>

Into a reactor equipped with a stirring device (three vanes), a heating/cooling device, a concentrating device and a device for charging various raw materials and additives, per 100 parts of the sum of styrene and butyl acrylate as monomers to be added in the second step, 71.9 parts of emulsified liquid A1 was charged and heated to 90° C. in a nitrogen stream with stirring.

Then, while the stirring was continued, 22.5 parts of a 1% V-50 aqueous solution was added and the system was maintained for 90 minutes.

<Second Step>

To the liquid in the first step, 40.6 parts of emulsified liquid A2, 20 parts of emulsified liquid A3 and 246 parts of deionized water were charged, and a mixture of the following monomers and emulsifier solution was added over a period of 4.2 hours. After 0.5 hour from the initiation of dropwise addition of the mixture of the monomers and emulsifier solution, dropwise addition of the following initiator aqueous solution 1 was also initiated. Thereafter, the initiator aqueous solution 2 was further added over a period of 2 hours. Thereafter, the system was maintained for 1 hour at an internal temperature of 90° C. with stirring.

[Monomers]

| | |
|---|---|
| Styrene | 76.3 parts |
| Butyl acrylate | 23.7 parts |
| Acrylic acid | 1.5 parts |
| Hexanediol diacrylate | 0.7 part |
| Trichlorobromomethane | 1.0 part |

[Aqueous Emulsifier Solution]

| | |
|---|---|
| 20% DBS aqueous solution | 1.0 part |
| Deionized water | 67.1 parts |

[Aqueous Initiator Solution 1]

| | |
|---|---|
| 8% Hydrogen peroxide aqueous solution | 17.2 parts |
| 8% L-(+) ascorbic acid aqueous solution | 17.2 parts |

[Aqueous Initiator Solution 2]

| | |
|---|---|
| 8% L-(+) ascorbic acid aqueous solution | 14.2 parts |

After completion of the polymerization reaction, the reaction system was cooled to obtain a milky white polymer primary particle dispersion C1. This dispersion was measured by means of Nanotrac, whereby the volume average particle diameter (MV) was 222 nm. The weight average molecular weight (Mw) was 69,000.

<Production of Toner Matrix Particles E1>

Into a mixer equipped with a stirring device (double helical vanes), a heating/cooling device, a concentrating device and a device for charging various raw materials and additives, 80 parts (solid content) of the polymer primary particle dispersion C1 was charged at room temperature (about 20° C.), and an aqueous solution containing 5% of ferrous sulfate (0.53 part as $FeSO_4.7H_2O$) was added over a period of 5 minutes, followed by stirring for 5 minutes to obtain a uniform mixture. Then, 4.4 parts (solid content) of a cyan pigment dispersion (EP700 manufactured by Dainichiseika Color & Chemicals Mfg. Co., Ltd.) was added over a period of 5 minutes and uniformly mixed, and then, 100 parts of deionized water was dropwise added thereto. Thereafter, the internal temperature was raised to 50° C. over a period of 30 minutes and further heated at a rate of 1° C./10 minutes, whereby the volume median particle diameter (Dv50) was measured by means of a Multisizer. When the agglomerated particle diameter reached 5.1 μm, the temperature raising was stopped, and while maintaining the temperature, 20 parts (solid content) of the polymer primary particle dispersion C1 was added over a period of 3 minutes, followed by maintaining the system for 30 minutes. Then, 6 parts (solid content) of the 20% DBS aqueous solution was added thereto, and the temperature was raised to 97° C. over a period of 60 minutes and maintained at that temperature.

When the average circularity of agglomerated particles measured by a flow type particle analyzer reached 0.97, the system was cooled to 30° C. over a period of 20 minutes, and the obtained slurry was withdrawn and subjected to suction filtration by means of an aspirator using a filter paper of No. 5C (No. 5C, manufactured by Toyo Roshi). A cake remained on the filter paper was transferred to a stainless steel container having an internal capacity of 10 L and equipped with a stirrer (propeller vanes), and 8 kg of ion exchanged water having an electrical conductivity of 1 μS/cm was added, followed by stirring at 50 rpm for uniform dispersion. Thereafter, the stirring was continued for 30 minutes.

Thereafter, suction filtration was again carried out by means of an aspirator using a filter paper of No. 5C, and the solid remained on the filter paper was again transferred to a stainless steel container having an internal capacity of 10 L, equipped with a stirrer (propeller vanes) and containing 8 kg of ion exchanged water having an electrical conductivity of 1 μS/cm, followed by stirring at 50 rpm for uniform dispersion, and the stirring was continued for 30 minutes. This process was repeated five times, whereupon the electrical conductivity of the filtrate became 2 μS/cm.

The cake thus obtained was spread on a stainless steel pad so that the height became 20 mm and dried for 48 hours in an air-circulating dryer set at 40° C. to obtain toner matrix particles E1.

The volume median diameter (Dv50) of the toner matrix particles E1 measured by means of Multisizer III was 5.6 μm, and the average circularity measured by a flow type particle analyzer was 0.971.

<Production of Toner F1 for Development>

Into Sample Mill KR-3 manufactured by Kyoritsu Riko, 100 parts of the toner matrix particles E1 were put, and then, 2.04 parts of silica particles having a volume average primary particle diameter of 80 nm and 0.36 part of silica particles having a volume average primary particle diameter of 30 nm were added, followed by stirring and mixing for a total of 5 minutes. Thereafter, 0.30 part of titania particles having a volume average primary particle diameter of 250 nm, treated with alumina, and 0.76 part of silica particles having a volume average primary particle diameter of 10 nm were added, followed by stirring and mixing for a total of 6 minutes and then by sieving to obtain a toner F1 for development.

The toner F1 for development had an endothermic peak of 0.4 mJ/mg with a half-value width of 4° C. at 39.4° C. and an endothermic main peak at 56.0° C. in the first temperature rise by DSC. Further, it had no peak at a temperature of at most 45° C. in the first cooling and in the second temperature rise.

Example 2

Preparation of Polymer Primary Particle Dispersion C2

Polymer primary particle dispersion C2 was obtained in the same manner as the production method for the polymer primary particle dispersion C1 except that the amount of the emulsified liquid A3 in the second step was changed to 10 parts instead of 20 parts. The volume average particle diameter (MV) measured by means of Nanotrac was 215 nm. The weight average molecular weight (Mw) was 70,000.

<Production of Toner Matrix Particles E2>

Toner matrix particles E2 were obtained in the same manner as the production method for the toner matrix particles E1 except that instead of the polymer primary particle dispersion C1, the polymer primary particle dispersion C2 was used.

The volume median particle diameter (Dv50) of the toner matrix particles E2 measured by means of Multisizer III was 5.8 μm, and the average circularity measured by means of a flow type particle analyzer was 0.969.

<Production of Toner F2 for Development>

Toner F2 for development was obtained in the same manner as for the production method for the toner F1 for development. The toner F2 for development had an endothermic peak of 0.1 mJ/mg with a half-value width of 3° C. at 43.0° C. and an endothermic main peak at 58.6° C. in the first temperature rise by DSC. Further, it had no peak at a temperature of at most 45° C. in the first cooling and in the second temperature rise.

Example 3

Preparation of Polymer Primary Particle Dispersion C3

Polymer primary particle dispersion C3 was obtained in the same manner as the production method for the polymer primary particle dispersion C1 except that the amount of the emulsified liquid A3 in the second step was changed to 30 parts instead of 20 parts. The volume average particle diameter (MV) measured by means of Nanotrac was 217 nm. The weight average molecular weight (Mw) was 70,000.

<Production of Toner Matrix Particles E3>

Toner matrix particles E3 were obtained in the same manner as the production method for the toner matrix particles E1 except that instead of the polymer primary particle dispersion C1, the polymer primary particle dispersion C3 was used.

The volume median particle diameter (Dv50) of the toner matrix particles E3 measured by means of Multisizer III was 5.4 μm, and the average circularity measured by means of a flow type particle analyzer was 0.972.

<Production of Toner F3 for Development>

Toner F3 for development was obtained in the same manner as the production method for the toner F1 for development. The toner F3 for development had an endothermic peak of 1.0 mJ/mg with a half-value width of 3° C. at 42.5° C. and an endothermic main peak at 57.5° C. in the first temperature rise by DSC. Further, it had no peak at a temperature of at most 45° C. in the first cooling and in the second temperature rise.

Example 4

Preparation of Polymer Primary Particle Dispersion C4

Polymer primary particle dispersion C4 was obtained in the same manner as the production method for the polymer primary particle dispersion C1 except that the amount of trichlorobromomethane added to the monomers in the second step was changed to 0.9 part instead of 1.0 part. The volume average particle diameter (MV) measured by means of Nanotrac was 243 nm. The weight average molecular weight (Mw) was 63,000.

<Production of Toner Matrix Particles E4>

Toner matrix particles E4 were obtained in the same manner as the production method for the toner matrix particles E1 except that instead of the polymer primary particle dispersion C1, the polymer primary particle dispersion C4 was used.

The volume median particle diameter (Dv50) of the toner matrix particles E4 measured by means of Multisizer III was 5.9 μm, and the average circularity measured by means of a flow type particle analyzer was 0.978.

<Production of Toner F4 for Development>

Toner F4 for development was obtained in the same manner as the production method for the toner F1 for development. The toner F4 for development had an endothermic peak of 0.4 mJ/mg with a half-value width of 3° C. at 42.6° C. and an endothermic main peak at 58.2° C. in the first temperature rise by DSC. Further, it had no peak at a temperature of at most 45° C. in the first cooling and in the second temperature rise.

Example 5

Preparation of Polymer Primary Particle Dispersion C5

Polymer primary particle dispersion C5 was obtained in the same manner as the production method for the polymer primary particle dispersion C1 except that the first step was omitted, and in the second step, the amounts of the emulsified liquid A2 and deionized water added to the reactor equipped with a stirring device (three vanes), a heating/cooling device, a concentrating device and a device for charging various raw materials and additives, were 35.6 parts and 254 parts, respectively. The volume average particle diameter (MV) measured by means of Nanotrac was 243 nm. The weight average molecular weight (Mw) was 72,000.

<Production of Toner Matrix Particles E5>

Toner matrix particles E5 were obtained in the same manner as the production method for the toner matrix particles E1 except that instead of the polymer primary particle dispersion C1, the polymer primary particle dispersion C5 was used.

The volume median particle diameter (Dv50) of the toner matrix particles E5 measured by means of Multisizer III was 5.6 μm, and the average circularity measured by means of a flow type particle analyzer was 0.971.

<Production of Toner F5 for Development>

Toner F5 for development was obtained in the same manner as the production method for the toner F1 for development. The toner F5 for development had an endothermic peak of 0.1 mJ/mg with a half-value width of 5° C. at 38.0° C. and an endothermic main peak at 75.7° C. in the first temperature rise by DSC. Further, it had no peak at a temperature of at most 45° C. in the first cooling and in the second temperature rise.

Example 6

Preparation of Polymer Primary Particle Dispersion C6

Polymer primary particle dispersion C6 was obtained in the same manner as the production method for the polymer primary particle dispersion C5 except that the amount of trichlorobromomethane added to the monomers in the second step was changed to 0.9 part instead of 1.0 part. The volume average particle diameter (MV) measured by means of Nanotrac was 247 nm. The weight average molecular weight (Mw) was 62,000.

<Production of Toner Matrix Particles E6>

Toner matrix particles E6 were obtained in the same manner as the production method for the toner matrix particles E1 except that instead of the polymer primary particle dispersion C1, the polymer primary particle dispersion C6 was used, and the charged amount of the polymer primary particle dispersion at the initial stage was changed to 100 parts instead of 80 parts, and no polymer primary particle dispersion was added thereafter.

The volume median particle diameter (Dv50) of the toner matrix particles E6 measured by means of Multisizer III was 5.6 μm, and the average circularity measured by means of a flow type particle analyzer was 0.974.

<Production of Toner F6 for Development>

Toner F6 for development was obtained in the same manner as the production method for the toner F1 for development. The toner F6 for development had an endothermic peak of 0.2 mJ/mg with a half-value width of 4° C. at 39.1° C. and an endothermic main peak at 75.4° C. in the first temperature rise by DSC. Further, it had no peak at a temperature of at most 45° C. in the first cooling and in the second temperature rise.

Comparative Example 1

Preparation of Polymer Primary Particle Dispersion C7

Polymer primary particle dispersion C7 was obtained in the same manner as the production method for the polymer primary particle dispersion C1 except that no emulsified liquid A3 was added in the second step. The volume average particle diameter (MV) measured by means of Nanotrac was 219 nm. The weight average molecular weight (Mw) was 64,000.

<Production of Toner Matrix Particles E7>

Toner matrix particles E7 were obtained in the same manner as the production method for the toner matrix particles E1 except that instead of the polymer primary particle dispersion C1, the polymer primary particle dispersion C7 was used.

The volume median particle diameter (Dv50) of the toner matrix particles E7 measured by means of Multisizer III was 5.6 μm, and the average circularity measured by means of a flow type particle analyzer was 0.969.

<Production of Toner F7 for Development>

Toner F7 for development was obtained in the same manner as the production method for the toner F1 for development. The toner F7 for development had an endothermic peak at 56.2° C., but had no peak at a temperature of at most 45° C. in the first temperature rise, in the first cooling and in the second temperature rise by DSC.

Comparative Example 2

Preparation of Polymer Primary Particle Dispersion C8

Polymer primary particle dispersion C8 was obtained in the same manner as the production method for the polymer primary particle dispersion C4 except that no emulsified liquid A3 was added in the second step. The volume average particle diameter (MV) measured by means of Nanotrac was 216 nm. The weight average molecular weight (Mw) was 59,000.

<Production of Toner Matrix Particles E8>

Toner matrix particles E8 were obtained in the same manner as the production method for the toner matrix particles E1 except that instead of the polymer primary particle dispersion C1, the polymer primary particle dispersion C8 was used.

The volume median particle diameter (Dv50) of the toner matrix particles E8 measured by means of Multisizer III was 5.6 μm, and the average circularity measured by means of a flow type particle analyzer was 0.973.

<Production of Toner F8 for Development>

Toner F8 for development was obtained in the same manner as the production method for the toner F1 for development. The toner F8 for development had an endothermic peak at 56.4° C., but had no peak at a temperature of at most 45° C. in the first temperature rise, in the first cooling and in the second temperature rise by DSC.

Comparative Example 3

Preparation of Polymer Primary Particle Dispersion C9

Polymer primary particle dispersion C9 was obtained in the same manner as the production method for the polymer primary particle dispersion C5 except that the amount of the emulsified liquid A3 added in the second step was changed to 4 parts instead of 20 parts. The volume average particle diameter (MV) measured by means of Nanotrac was 248 nm. The weight average molecular weight (Mw) was 63,000.

<Production of Toner Matrix Particles E9>

Toner matrix particles E9 were obtained in the same manner as the production method for the toner matrix particles E1 except that instead of the polymer primary particle dispersion C1, the polymer primary particle dispersion C9 was used.

The volume median particle diameter (Dv50) of the toner matrix particles E9 measured by means of Multisizer III was 5.6 μm, and the average circularity measured by means of a flow type particle analyzer was 0.974.

<Production of Toner F9 for Development>

Toner F9 for development was obtained in the same manner as the production method for the toner F1 for development. The toner F9 for development had an endothermic peak at 75.3° C., but had no peak at a temperature of at most 45° C. in the first temperature rise, in the first cooling and in the second temperature rise by DSC.

Comparative Example 4

Preparation of Polymer Primary Particle Dispersion C10

Polymer primary particle dispersion C10 was obtained in the same manner as the production method for the polymer primary particle dispersion C1 except that in the second step, instead of the emulsified liquid A3, A1 was added. The volume average particle diameter (MV) measured by means of Nanotrac was 217 nm. The weight average molecular weight (Mw) was 69,000.

<Production of Toner Matrix Particles E10>

Toner matrix particles E10 were obtained in the same manner as the production method for the toner matrix particles E1 except that instead of the polymer primary particle dispersion C1, the polymer primary particle dispersion C10 was used.

The volume median particle diameter (Dv50) of the toner matrix particles E10 measured by means of Multisizer III was 5.6 μm, and the average circularity measured by means of a flow type particle analyzer was 0.976.

<Production of Toner F10 for Development>

Toner F10 for development was obtained in the same manner as the production method for the toner F1 for development. The toner F10 for development had an endothermic peak at 56.2° C., but had no peak at a temperature of at most 45° C. in the first temperature rise, in the first cooling and in the second temperature rise by DSC.

Comparative Example 5

Preparation of Polymer Primary Particle Dispersion C11

Polymer primary particle dispersion C11 was obtained in the same manner as the production method for the polymer primary particle dispersion C4 except that in the second step, instead of the emulsified liquid A3, A1 was added. The volume average particle diameter (MV) measured by means of Nanotrac was 214 nm. The weight average molecular weight (Mw) was 68,000.

<Production of Toner Matrix Particles E11>

Toner matrix particles E11 were obtained in the same manner as the production method for the toner matrix particles E1 except that instead of the polymer primary particle dispersion C1, the polymer primary particle dispersion C11 was used.

The volume median particle diameter (Dv50) of the toner matrix particles E11 measured by means of Multisizer III was 5.5 μm, and the average circularity measured by means of a flow type particle analyzer was 0.982.

<Production of Toner F11 for Development>

Toner F11 for development was obtained in the same manner as the production method for the toner F1 for development. The toner F11 for development had an endothermic peak at 56.3° C., but had no peak at a temperature of at most 45° C. in the first temperature rise, in the first cooling and in the second temperature rise by DSC.

Comparative Example 6

Preparation of Polymer Primary Particle Dispersion C12

Polymer primary particle dispersion C12 was obtained in the same manner as the production method for the polymer primary particle dispersion C1 except that the first step was omitted, and in the second step, A3 was not added to the reactor equipped with a stirring device (three vanes), a heating/cooling device, a concentrating device and a device for charging various raw materials and additives, and the amounts of the emulsified liquid A2 and deionized water added were 36 parts and 226 parts, respectively, and further, the mixture of monomers and emulsifier solution was added over a period of 5 hours. The volume average particle diameter (MV) measured by means of Nanotrac was 235 nm. The weight average molecular weight (Mw) was 75,000.

<Production of Toner Matrix Particles E12>

Toner matrix particles E12 were obtained in the same manner as the production method for the toner matrix particles E6 except that instead of the polymer primary particle dispersion C6, the polymer primary particle dispersion C12 was used.

The volume median particle diameter (Dv50) of the toner matrix particles E12 measured by means of Multisizer III was 5.7 μm, and the average circularity measured by means of a flow type particle analyzer was 0.974.

<Production of Toner F12 for Development>

Toner F12 for development was obtained in the same manner as the production method for the toner F1 for development. The toner F12 for development had an endothermic peak at 75.9° C., but had no peak at a temperature of at most 45° C. in the first temperature rise, in the first cooling and in the second temperature rise by DSC.

Comparative Example 7

Preparation of Polymer Primary Particle Dispersion C13

Polymer primary particle dispersion C13 was obtained in the same manner as the production method for the polymer primary particle dispersion C1 except that in the second step, instead of the emulsified liquid A3, A4 was added. The volume average particle diameter (MV) measured by means of Nanotrac was 254 nm. The weight average molecular weight (Mw) was 67,000.

<Production of Toner Matrix Particles E13>

Toner matrix particles E13 were obtained in the same manner as the production method for the toner matrix particles E6 except that instead of the polymer primary particle dispersion C6, the polymer primary particle dispersion C13 was used.

The volume median particle diameter (Dv50) of the toner matrix particles E13 measured by means of Multisizer III was 5.7 μm, and the average circularity measured by means of a flow type particle analyzer was 0.974.

<Production of Toner F13 for Development>

Toner F13 for development was obtained in the same manner as the production method for the toner F1 for development. The toner F13 for development had an endothermic peak at 75.6° C., but had no peak at a temperature of at most 45° C. in the first temperature rise, in the first cooling and in the second temperature rise by DSC.

Using the above toners F1 to F13 for development, image quality evaluation was carried out as follows.

<Blocking Resistance>

5 g of a toner for development was put in a cylindrical container having an inner diameter of 3 cm and a height of 6 cm, and a load of 40 g was exerted thereon, and under this condition, the toner was left to stand for 24 hours at a temperature of 50° C. under a humidity of 40%. After that, remove the container, and exerted a load above the toner to ascertain the degree of aggregation.

◎ (good): Disintegrated by a load of less than 200 g.

○ (practically acceptable): Disintegrated by a load of less than 500 g.

x (practically not acceptable): Aggregated and not disintegrated unless a load of at least 500 g is exerted.

<Image Quality Evaluation>

Using an obtained toner, continuous printing was carried out at a printing ratio of 5% at a printing speed of 210 mm/s in a non-magnetic one component system with a guaranteed number of copies being 10,000 copies (at a printing ratio of 5%) by means of a full color printing having mounted a developing rubber roller, a metal blade, an organic photoreceptor to be electrified by an electrification roller (PCR) and a belt fixing equipment employing a belt transfer heat fixing system.

<Method for Measuring Fogging>

By means of an image-forming apparatus, the color difference ΔE of the white background portion of standard paper (OKI excellent white) between before printing and after printing, was measured by X-Rite938 (manufactured by X-Rite), and the fogging was judged by the following standards based on ΔE.

◎ (good): $\Delta E<0.8$

○ (fogging slightly observed): $0.8\leq\Delta E\leq1.2$ x (substantial fogging): $1.2\leq\Delta E$ <Fixing Test>

Recording paper (OKI excellent white) having formed a non-fixed toner image in an attached amount of 200% (attached amount: 0.7 to 0.8 mg/cm$^2$) was prepared, and while the surface temperature of the heating roller was changed every 5° C. from 100° C. to 195° C., the recording paper was transported to a fixing nip portion and discharged at a rate of 243 mm/sec, whereby the fixing state was observed. A temperature region wherein the toner on recording paper after fixing is sufficiently bonded to the recording paper without offset of the toner or paper winding on the heating roller during the fixing, is taken as the fixing temperature region. As the fixing equipment, a belt fixing equipment employing a heat fixing system was used, and evaluation was made without applying silicone oil.

The minimum fixing temperature in the fixing temperature region was designated as Tmin, and the low temperature fixing property was judged by the following standards.

◎ Tmin<155° C.

○ Tmin=155° C.

Δ Tmin=160° C.

x Tmin>160° C.

The fixing temperature range in the fixing temperature region was designated as ΔT, and the fixing temperature range was judged by the following standards.

ΔT=Tmax (maximum fixing temperature)−Tmin (minimum fixing temperature)

◎ ΔT>40° C.

○ 40° C.>=ΔT>35° C.

x ΔT<=35° C.

TABLE 1

| | Examples | | | | | | Comparative Examples | | | | | | |
|---|---|---|---|---|---|---|---|---|---|---|---|---|---|
| | 1 | 2 | 3 | 4 | 5 | 6 | 1 | 2 | 3 | 4 | 5 | 6 | 7 |
| Blocking resistance | ◎ | ◎ | ○ | ◎ | ◎ | ◎ | ◎ | ◎ | ◎ | X | X | ◎ | X |
| Fogging | ◎ | ◎ | ◎ | ◎ | ◎ | ◎ | ◎ | ◎ | ◎ | — | — | ◎ | — |
| Low temperature fixing property | ◎ | ○ | ◎ | ○ | ○ | ◎ | Δ | X | Δ | — | — | X | — |
| Fixing temperature range | ◎ | ○ | ◎ | ○ | ○ | ◎ | X | X | X | — | — | X | — |

MEANINGS OF SYMBOLS

The following symbols refer to the numbers in FIG. 1:

1: DSC curve during the first temperature rise

2: DSC curve during the second temperature rise

3: DSC curve during the first cooling

4: Endothermic peak temperature

5: Half-value width

The entire disclosure of Japanese Patent Application No. 2010-121983 filed on May 27, 2010 including specification, claims, drawings and summary is incorporated herein by reference in its entirety.

What is claimed is:

1. A toner for developing an electrostatic charge image, which comprises a binder resin and wax, and which has, in its DSC curve measured by a differential scanning calorimeter, an endothermic peak of from 0.01 to 10 mJ/mg at a temperature of at most 45° C. during its temperature rise, and which has no exothermic peak at a temperature of at most the temperature for the endothermic peak present at a temperature of at most 45° C., during cooling after the toner is heated to 120° C.

2. The toner for developing an electrostatic charge image according to claim 1, which has no endothermic peak at a temperature of at most 45° C., when the toner is heated to 120° C., then cooled to −20° C. and then heated again.

3. The toner for developing an electrostatic charge image according to claim 2, wherein the endothermic peak present at a temperature of at most 45° C., is present at a temperature of at least 20° C.

4. The toner for developing an electrostatic charge image according to claim 2, wherein the endothermic peak is not present at a temperature of from 20 to 45° C.

5. The toner for developing an electrostatic charge image according to claim 1, wherein the half-value width of the endothermic peak of the toner at a temperature of at most 45° C. during its temperature rise is at most 10° C.

6. The toner for developing an electrostatic charge image according to claim 1, which has a long chain (meth)acrylate polymer as the binder resin.

7. The toner for developing an electrostatic charge image according to claim 1, wherein the binder resin contains a crystalline resin.

8. The toner for developing an electrostatic charge image according to claim 7, wherein the crystalline resin has a melting point of from 45 to 80° C.

9. The toner for developing an electrostatic charge image according to claim 1, wherein the toner further contains a colorant.

10. A process for producing the toner for developing an electrostatic charge image as defined in claim 1, said toner comprising at least a binder resin and wax, wherein the binder resin is produced via a step of polymerizing a long chain (meth)acrylic acid ester and a vinyl monomer, and the ester moiety of the ester contains at least a component having at least 22 carbon atoms.

11. The process for producing the toner for developing an electrostatic charge image according to claim 10, wherein the polymerization step is carried out in the presence of a polymer obtained by polymerizing an ester which is a long chain (meth)acrylic acid ester, of which the ester moiety contains at least a component having at least 18 carbon atoms.

* * * * *